US005716201A

United States Patent [19]

Peck et al.

[11] Patent Number: 5,716,201

[45] Date of Patent: Feb. 10, 1998

[54] VARIABLE DISPLACEMENT VANE PUMP WITH VANE TIP RELIEF

[75] Inventors: Robert Peck, Prospect, Conn.; Martin Thomas Books, Columbus, Ind.; Francis Tokarski, Southampton, Mass.; Bernard J. Bisson, Winsted, Conn.; Raymond D. Zagranski, Somers, Conn.; Mihir C. Desai, Yorba Linda, Calif.

[73] Assignee: Coltec Industries Inc., New York, N.Y.

[21] Appl. No.: 509,399

[22] Filed: Jul. 31, 1995

[51] Int. Cl.[6] ..... F01C 21/16

[52] U.S. Cl. ..... 418/30; 418/180; 418/189; 417/284

[58] Field of Search ..... 418/30, 31, 180, 418/189, 259, 268; 417/284

[56] References Cited

U.S. PATENT DOCUMENTS

| | | | |
|---|---|---|---|
| 2,433,484 | 12/1947 | Roth | 418/30 |
| 4,919,248 | 4/1990 | Hiramatsu et al. | 418/180 |
| 5,046,933 | 9/1991 | Haga et al. | 418/180 |
| 5,141,418 | 8/1992 | Ohtaki et al. | 418/268 |
| 5,366,354 | 11/1994 | Yuge | 418/30 |

FOREIGN PATENT DOCUMENTS

| | | | |
|---|---|---|---|
| 1451350 | 1/1988 | U.S.S.R. | 418/180 |

*Primary Examiner*—Charles G. Freay
*Attorney, Agent, or Firm*—Howard S. Reiter

[57] ABSTRACT

A variable displacement vane pump having a vaned rotor adjustably contained within a cam member for rotation between fuel inlet and fuel discharge arcs. Adjacent vanes form enclosed fuel bucket areas which are expanded and axially-supplied with fuel in the fuel inlet arc and are contracted and axially-discharge the fuel in the fuel discharge arc. Fuel circulation is improved by providing a central recess at each vane tip and/or a central groove in the cam surface to prevent trapping, stagnation and overheating of fuel at the centerpoints of the bucket areas, which overheating can result in expansion of the vane tips, scoring of the cam surface and pump failure.

10 Claims, 5 Drawing Sheets

VARIABLE DISPLACEMENT VANE PUMP WITH VANE TIP RELIEF

BACKGROUND OF THE INVENTION

1. Field of the Invention

The present invention relates to single acting, variable displacement fluid pressure vane pumps, such as fuel and hydraulic control pumps for aircraft use.

Over the years, the standard of the commercial aviation gas turbine industry for main engine fuel pumps has been a single element, pressure-loaded, involute gear stage charged with a centrifugal boost stage. Such gear pumps are simple and extremely durable, although heavy and inefficient. However, such gear pumps are fixed displacement pumps which deliver uniform amounts of fluid, such as fuel, under all operating conditions. Certain operating conditions require different volumes of liquid, and it is desirable and/or necessary to vary the liquid supply, by means such as bypass systems which can cause overheating of the fuel or hydraulic fluid and which require heat transfer cooling components that add to the cost and the weight of the system.

2. State of the Art

Vane pumps and systems have been developed in order to overcome some of the deficiencies of gear pumps, and reference is made to the following U.S. patents for their disclosures of several such pumps and systems: U.S. Pat. Nos. 4,247,263; 4,354,809; 4,529,361 and 4,711,619.

Vane pumps comprise a rotor element machined with axial slots supporting radially-movable vane elements, mounted within a cam member having fluid inlet and outlet ports in the faces of the cam member through which the fluid is fed radially to the inlet areas or buckets of the rotor surface for compression and discharge from the outlet areas or buckets of the rotor surface and axially in both directions as pressurized fluid.

Vane pumps that are required to operate at high speeds and pressures preferably employ hydrostatically (pressure) balanced vanes for maintaining vane contact with the interior cam surface in seal arcs and for minimizing frictional wear. Such pumps may also include radially-rounded vane tips to reduce vane-to-cam surface stresses. Examples of vane pumps having pressure-balanced vanes which are also adapted to provide undervane pumping, may be found in U.S. Pat. Nos. 3,711,227 and 4,354,809. The latter patent discloses a vane pump incorporating undervane pumping wherein the vanes are hydraulically balanced in not only the inlet and discharge areas but also in the seal arcs whereby the resultant pressure forces on a vane cannot displace it from engagement with the interior cam surface in seal arc areas.

Variable displacement vane pumps are known which contain a swing cam element which is adjustable or pivotable, relative to the rotor element, in order to change the relative volumes of the inlet and outlet or discharge buckets and thereby vary the displacement capacity of the pump.

Among the disadvantages of known vane pumps are their lack of durability, susceptibility to wear, complexity of rotor and cam structures, necessity for end sealing plates to seal the ends of the rotor for the purpose of containing the pressurized fluid, and other essential elements which can provide vane pumps with variable metering properties not possessed by gear pumps but which detract from their durability or life span relative to the comparative durability and life spans of gear pumps. In conventional vane pumps the rotor is splined upon and driven by a central drive shaft having small diameter journal ends which are not strong enough to withstand the opposed inlet and outlet hydraulic pressure forces generated during normal operation. This problem is overcome by forming such pumps as double-acting pumps having opposed inlet arcs and opposed outlet or discharge arcs which balance the forces exerted upon the journal ends, as disclosed by the prior art such as U.S. Pat. Nos. 4,354,809 and 4,529,361, for example.

The present invention is directed to improving the durability and reducing the susceptibility to wear with respect to the vane tips and the cam surface upon which they ride. In double acting vane pumps the liquid, such as fuel, is admitted to the cam chamber axially, from both directions, in the low pressure inlet arc areas, and is pumped or discharged axially, in both directions in the high pressure discharge arc areas. This has been found to result in overheating of the tips of the vanes, at their centerpoints, causing uneven wear of the vane tips and scoring of the cam surface.

SUMMARY OF THE INVENTION

The present invention relates to novel single acting, variable displacement vane pumps, and components thereof, which have the durability, ruggedness and simplicity of conventional gear pumps, and the versatility and variable metering properties of vane pumps, while incorporating novel features and properties not heretofore possessed by prior known pumps of either type.

The novel vane pumps of the present invention avoid the vane tip overheating and wear problems of prior known vane pumps by providing the surface of each vane tip, and/or the cam surface, with a central fluid-permeable recess or groove, which functions as a pressure relief or sump at the symmetrical center of the pump to avoid or relieve flow stagnation. Such flow stagnation, due to the even introduction and the even discharge of the liquid fuel in opposed axial directions has been found to result in an isolation or stagnation of a portion of the liquid and a loss of cooling of the vane tips, at the midpoint of their contact surfaces with the cam surface at the inside diameter of the cam, resulting in thermal expansion or bowing of the vane tips and scoring of cam surface in such areas.

Applicants have discovered that fluid flow stagnation, and the consequences thereof are avoided by providing the aforementioned vane tip recesses and/or cam surface groove to prevent the fluid from being isolated in the areas of the centerpoints of the vane tip surfaces and/or at the central circumference of the inner cam surface, where it will stagnate and increase in temperature and be unable to perform an intended function of cooling the vane tips and the cam surface. The vane tip recesses and/or cam surface groove of the present invention enable the liquid, such as fuel, to circulate beyond the midpoint of the vanes by flowing through the vane tip recesses into an adjacent bucket area in the same arc and/or circumferentially over the inner cam surface during axial introduction of the fuel and also during axial discharge of the fuel, whereby fresh fluid, having cooling properties, is introduced and displaces prior fluid during each cycle of operation of the pump. Moreover, the vane tip recesses and/or cam surface groove separate the vane tips and cam surface from each other at the centerpoint to avoid any friction or wear in this area.

The novel pumps of the present invention comprise a durable, substantially uniform diameter rotor member which is machined from barstock, similar in manner and appearance to the main pumping gear of a gear pump. The rotor has large diameter journal ends at each side of a central vane section which comprises a plurality of radially-extending teeth, adjacent pairs of said teeth being formed as wall extensions of a plurality of axially-elongated radial vane slots having central deeper well areas, slidably-engaging a mating vane element. The rotor slots are such that the vanes may be significantly greater in thickness than is permitted in pumps constructed in accordance with the prior art. Axial grooves or depressions may be included in the surface of the rotor between the vane slots. These depressions provide increased volume, to reduce sudden pressure build-up which can occur when the enclosed volume between the vanes is reduced as it is during the pumping process. This can create an effect similar to "water hammer" in a residential plumbing system. An adjustable, narrow cam member having a continuous circular inner cam surface eccentrically surrounds and encloses the central vane section, and the cam surface is engaged by the outer surfaces of the vane elements during operation of the pump. The cam housing is provided with means for adjusting the operating "displacement" of the pump. Pressure forces within the cam are directed axially in both directions, through the porting structures or fluid outlets of the pump, so that the cam loads are centrally (i.e., symmetrically) located relative to a pivot, thereby reducing the force needed to actuate the cam and reducing the stresses on the pivot. The journal ends of the rotor member are rotatably supported within opposed durable bearings, such as manifold bearings which may be made for example from barstock material, and which have manifold faces which contact and seal opposite faces of the cam member and overlap the outer ends of the elongated radial vane slots. Each manifold bearing has interior inlet and discharge passages communicating with the cam—contacting manifold faces. The latter comprise an inlet arc segment opening to the inlet passages of the bearing, and a smaller discharge arc segment opening to the discharge passages of the bearing, separated from each other by opposed small sealing arc segments. Rotation of the journals of the vaned rotor member within the manifold bearings and of the central vane section within the cam member causes fluid such as liquid fuel to be admitted axially from both directions through the inlet arc segments of the bearings into the cam chamber and into expanding inlet bucket chambers between the vanes, and also through the inlet manifold passages and the vane slot extensions to under-vane chambers. Continued rotation of the rotor member through a sealing arc segment into a discharge arc segment changes the pressure acting upon the leading face of each vane from inlet pressure to increasing discharge pressure as the volume of each bucket chamber is gradually compressed at the discharge side or arc of the eccentric cam chamber. The pressurized fuel escapes axially, in both directions, into the discharge ports of each manifold bearing, through the discharge passages, and is channelled to its desired destination.

The pressures acting upon the vanes are balanced so that the vanes are lightly loaded or "floated" throughout the operation of the present pumps. This reduces wear on the vanes, permits the use of thicker, more durable vanes and, most importantly, provides elasto-hydrodynamic lubrication of the interface of the vane tips and the continuous cam surface. Such balancing is made possible by venting the undervane slot areas to an intermediate fluid pressure in the seal arc segments of the manifold bearings whereby, as each vane is rotated from the low pressure inlet segment to the high pressure discharge segment, and vice versa, the pressure in the undervane slot areas is automatically regulated to an intermediate pressure at the seal arc segments, whereby the undervane and overvane pressures are balanced which prevents the vane elements from being either urged against the cam surface with excessive force or from losing contact with the cam surface. The intermediated pressure at the seal arc segments is derived from the servo piston pressure which is used to move the cam.

The regulation of the undervane pressure permits the use of thicker, more durable vanes by eliminating the unbalanced pressures which are found in the prior art. Within the inlet arcs of the present pumps the undervane areas are subjected to inlet pressure as are the overvane areas. Within the outlet arcs of the pump, the undervane areas are subjected to outlet pressure as are the overvane areas. Within the seal arcs of the pump, the undervane areas are subjected to a pressure that is midway between inlet and discharge pressure, to compensate for the overvane areas which are also subjected half to inlet and half to discharge. More importantly, the regulation of the undervane pressure and "floating" of the vanes causes the centrally-recessed tips of the present vanes to float over the optionally-grooved cam surface which is lubricated by the fluid being pumped, whereby metal-to-metal contact and wear are eliminated at the center of the pump. This overcomes the need for hard, brittle, wear-resistant, heavy metals, such as tungsten carbide, for the vanes and/or for the cam surface and permits the use of softer, more ductile, lightweight metals, particularly if the outer vane tips are radiused or rounded and a wear resistant coating, such as of titanium nitride, is applied to the outer rounded vane tip surfaces and to the cam surface.

The novel vane pumps of the present invention preferably also provide substantial undervane pumping of the fluid from the undervane slot areas axially in both directions by piston action as the vanes are depressed into the slots at the discharge side of the cam chamber. Such undervane pumping can contribute up to 40% or more of the total fluid displacement.

DETAILED DESCRIPTION

Figure 1:
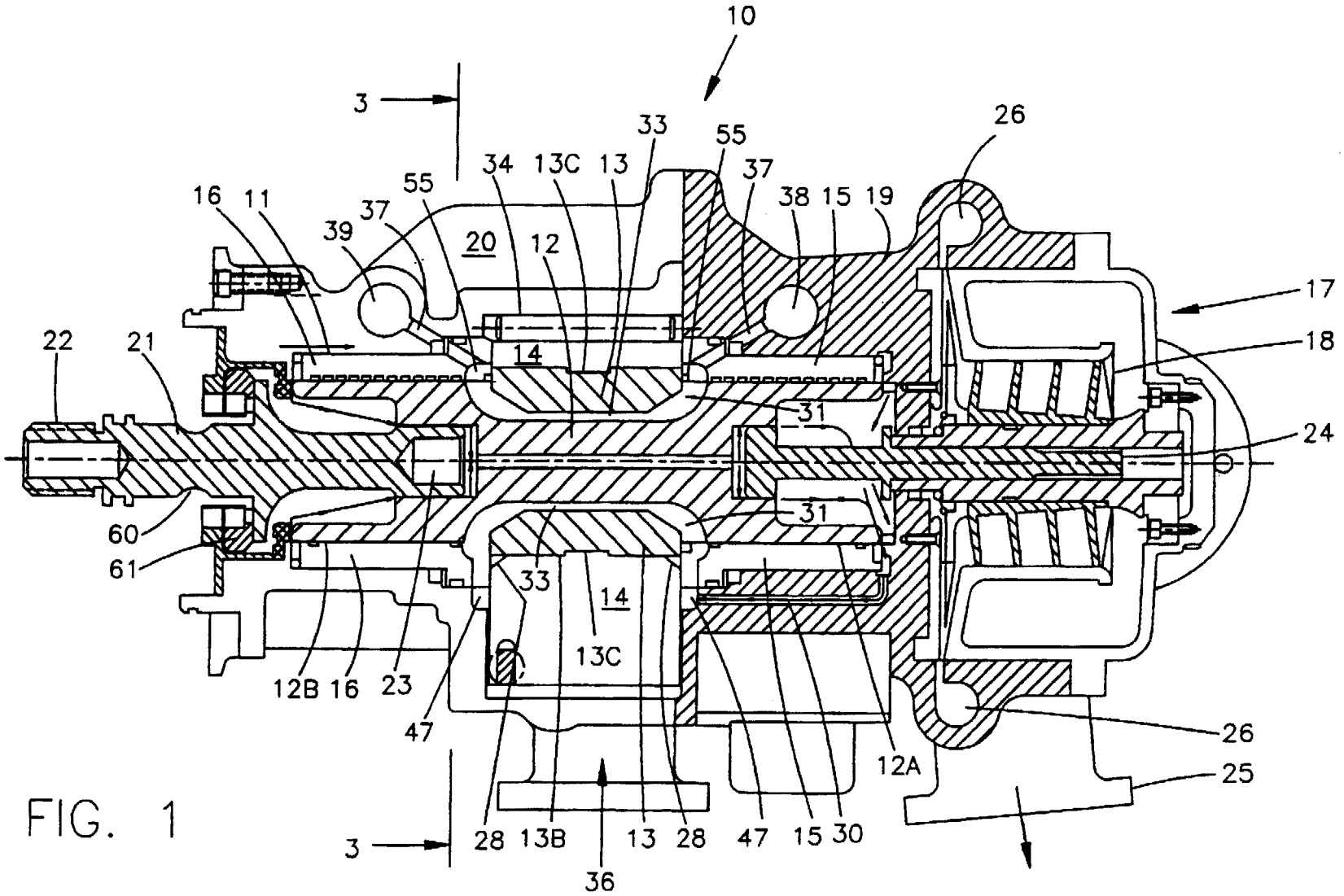
FIG. 1 is a schematic cross-sectional view of a fuel pump assembly according to one embodiment of the present invention, illustrating fluid flow paths therethrough.

Referring to FIG. 1, the fuel pump assembly 10 thereof comprises a variable displacement single acting vane pump 11 having a rugged barstock rotor member 12 having a plurality of vane elements 13 radially-supported within axially-elongated, concave vane slots 32 disposed around the central area of the rotor member 12. The outer tip **13*b* of each vane element 13 is provided with a central surface recess 13*c*, and the tips 13*b* preferably are rounded to reduce their areas of contact with the interior continuous surface 14a (FIG. 3) of an adjustable cam member 14, and a pair of manifold bearing blocks or members 15 and 16 rotatably support the large diameter journal ends 12a and 12b of the rotor member 12 and provide axial sealing of the pressurized cam chamber. In this regard, the blocks 15 and 16** serve the function of the "side" or "end" plates of a conventional vane pump.

The cam chamber of the vane pump 11 is fed axially, in both directions, with fluid from a centrifugal boost stage 17 comprising an axial inducer and radial impeller 18 and associated collector and diffuser means 26 mounted within a housing section 19 connected to a housing section 20 mountable on a main engine gearbox.

Power is extracted in conventional manner from an engine through a main drive shaft 21 which includes an oil-lubricated main drive spline 22, a fuel-lubricated internal drive spline 23, a shear section 60 and a main shaft seal 61. A second shaft 24 drives the boost stage 17 from a common spline with the main shaft 21.

Figure 2:
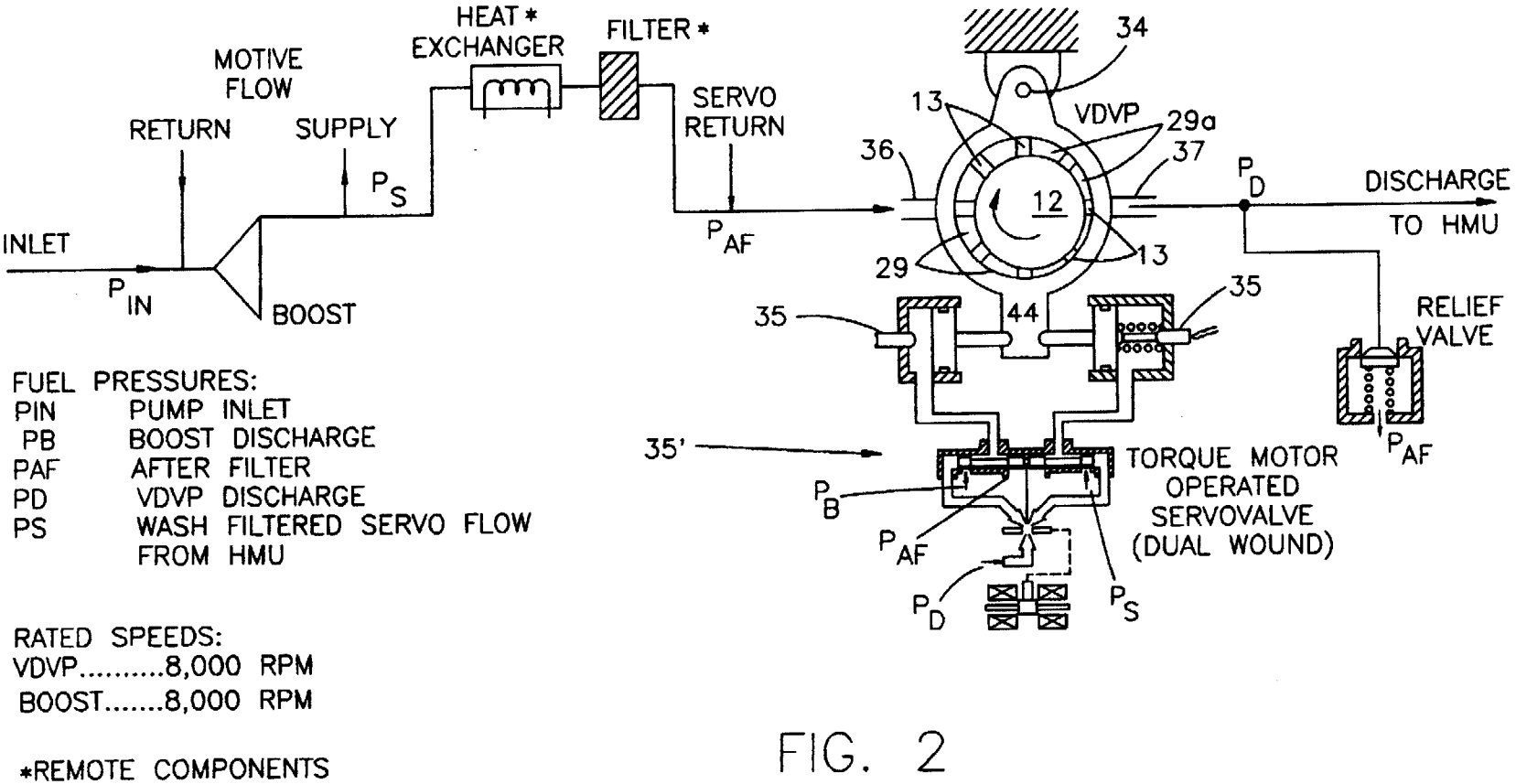
FIG. 2 is a schematic diagram of the fuel pumping system through the assembly of FIG. 1, including an adjustment system for the cam member to vary the fuel displacement volume.
Figure 3:
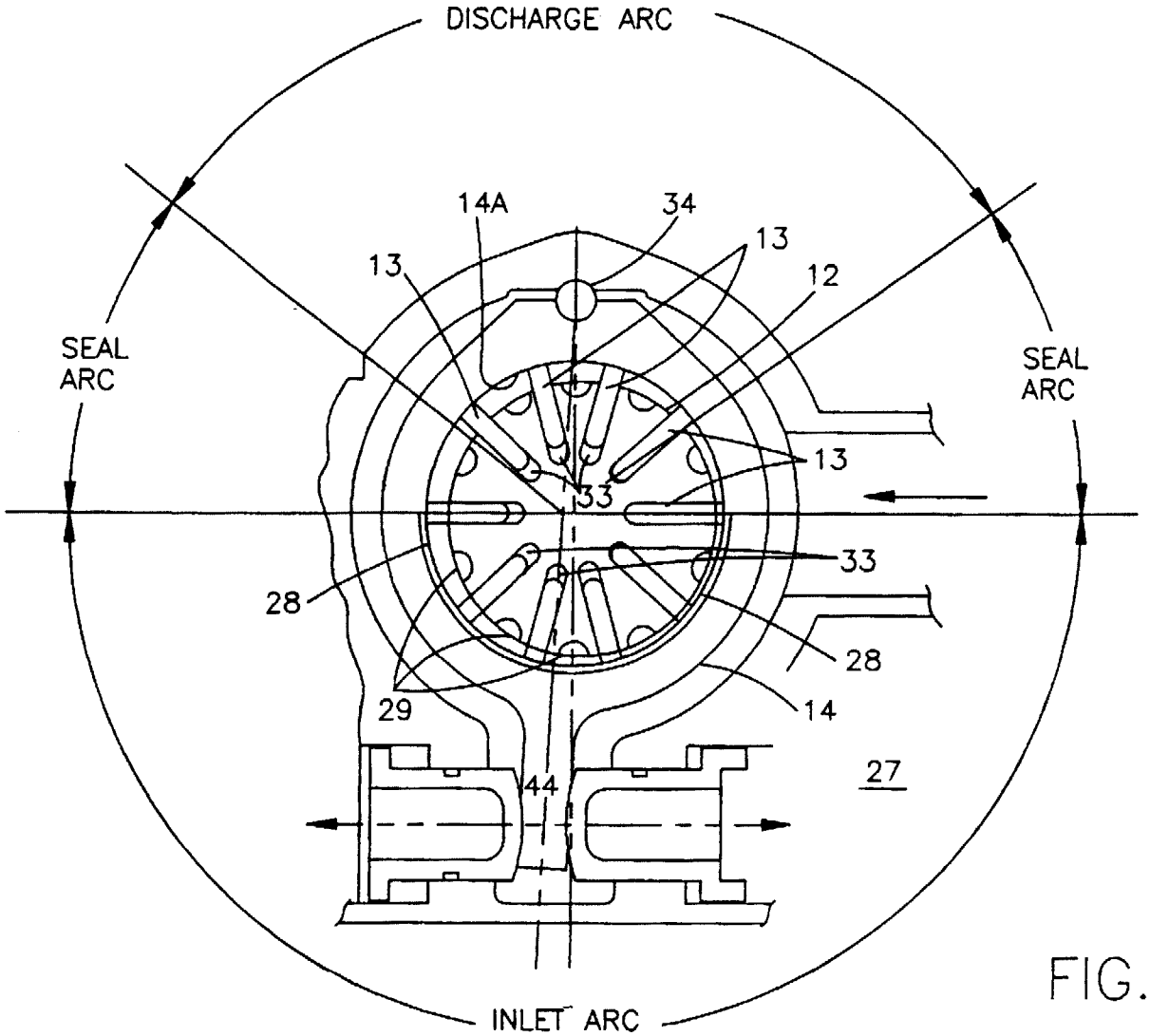
FIG. 3 is a schematic cross-sectional view of the single acting vane stage of FIG. 1 taken along the line 3—3 thereof.

The pump is mounted to the main engine gearbox, and ports are provided to passages through the housing section 19 for an outlet 25 from the boost stage 17 through diffuser means 26 to an external heat exchanger and filter (FIG. 2) and back into inlet passage 36 (FIG. 2) to the inlet arc section 27 of the manifold bearings 15 and 16 for axial introduction of the fuel, under inlet pressure, past the hemispherical bevels or undercut slots 28 on the opposed faces of the cam member 14 in the area of the inlet arc of the cam chamber and into the expanding fuel inlet buckets 29 formed between adjacent vane elements 13 within the inlet arc section of the cam member 14, as shown in FIG. 3.

Figure 4:
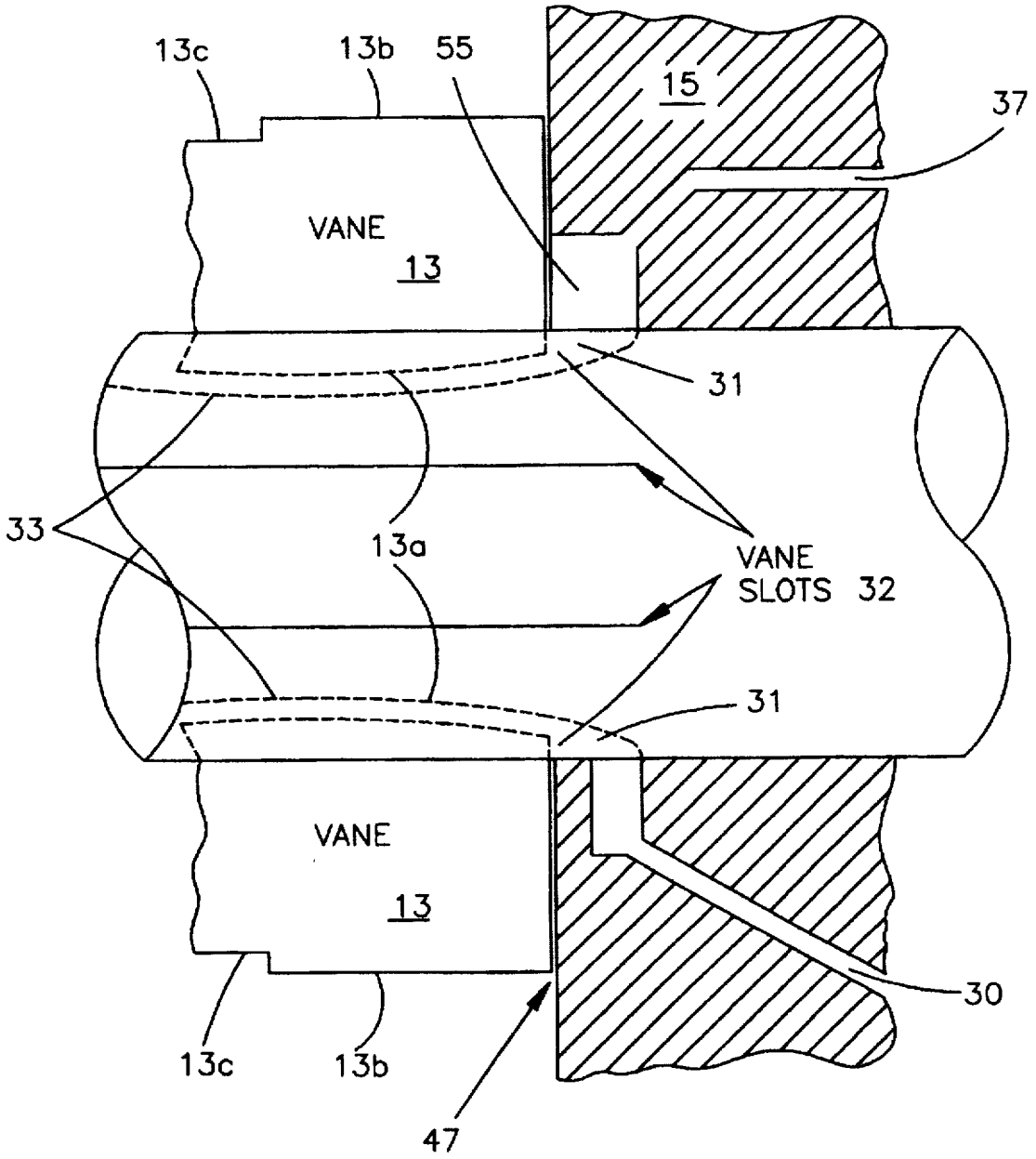
FIG. 4 is a simplified schematic depiction of the supply or discharge of fluid to or from the undervane slot areas in the areas of the inlet and discharge arcs respectfully, and of the porting of the undervane slot areas to an intermediate, balancing pressure in the areas of the seal arcs of the cam chamber.

Rotation of the rotor 12 and vanes 13 within the cam member 14 causes the inlet buckets 29 to move into a 36° seal arc area where they become isolated from the 180° inlet arc sections 27 of the manifold bearings 15 and 16 and begin to become compressed due to the non-concentric axial position of the rotor member 12 within the cam chamber, as shown in FIG. 3. Within the seal arc zones, which are transition zones between the lower-pressurized inlet pressure zone and the 180° increased discharge pressure zone, each vane experiences a different overvane pressure on each side of it, which normally can cause intermediate overvane forces. However, as illustrated by FIG. 4, the present pumps provide special pressure relief passages 30 to a source of fluid at intermediate pressure in the seal arc areas whereby fuel is supplied at intermediate pressure through axial passages 30 in the manifold bearings 15 and 16 (FIG. 1) to the extremities 31 of the vane slots 32, beyond the vane elements 13, to produce an intermediate fluid pressure in the undervane slot areas 33 which balances the overvane fluid pressures and reduces the stresses or forces exerted by the vane tip surfaces against the continuous cam surface 14a in the area of the sealing arc zones. As can be seen from FIGS. 3 and 4, the undervane areas 33 are biased directly to inlet pressure, through slot extensions 31 and bearing ports and passages when the vane is in the inlet arc, and to discharge pressure when the vane is rotated to the discharge arc zone. In this manner, the vane loading in the inlet, seal, and discharge arc zones is held to very tolerable levels since the vane loads are achieved primarily through a combination of balanced pressure forces an low dynamic forces.

FIG. 2 is a simplified depiction of a cam member mechanism adjustable between minimum and maximum displacement flow positions. The cam 14 pivots on a pin 34 supported within housing section 20 at the top of the pump structure member. The pump is at maximum displacement when the cam 14 is positioned so that the vane buckets experience maximum contraction in the discharge arc zone. Likewise, minimum flow occurs when the cam 14 and the rotor 12 are almost concentric. Mechanical stops 35 are designed into a piston adjustment system 35' to limit cam displacement, generally, for the purpose of assuring that the cam will not contact the rotor surface (exceeds max displacement). These stops include shims for final production calibration. The piston adjustment system 35' is supplied with fluid at a predetermined pressure selected to be "intermediate" or "half-way" between the inlet and discharge pressures of the pump. This arrangement permits the use of a common source of fluid pressure (not shown) for both the adjustment system 35' and the axial relief pressure passages 30 and associated sealing arc ports, passages 30 being shown in FIG. 4 and described elsewhere herein.

As illustrated by FIGS. 1 and 2, the fuel exits the booster stage 17 of the pump through an external flanged outlet 25 and a collector/diffuser means 26 from the axial inducer/impeller 18 at the front of the boost stage 17. The axial inducer imparts sufficient pressure rise to the fluid to eliminate poor quality effects associated with line losses or fuel boiling and assures that the main impeller, downstream from the inducer, will be handling non-vaporous liquid. Angled slots in the impeller hub allow some of the flow to move from the front to the back side of the impeller. Hence fuel passes radially outward through the vaned passages on both sides of the impeller, subsequently to be collected and diffused. As shown in FIG. 2, the fuel exits the booster stage 17 through outlet 25 to pass through the external engine heat exchanger and filter, subsequently, to return, via an inlet passage 36 in housing section 20, to the main vane stage. Fuel enters around the main vane stage cam 14 in the inlet arc zone 27 and is admitted, axially, to the expanding inlet vane buckets 29 through an undercut slot 28 on each cam face from face recesses in each of the bearings 15 and 16 and on both sides of the cam 14. Each vane bucket 29 then carries the fuel circumferentially into the discharge arc where contracting discharge buckets 29a squeeze the fuel axially outward into discharge ports 55 cut into the faces of the bearings 15 and 16 in the discharge arc zone, subsequently to be discharged to the engine through cored passages 38 and 39 in the housing sections 19 and 20. FIG. 1 provides a depiction of the flow path through the system.

As illustrated by FIGS. 1 and 4, the fuel inlets to the cam chamber open through passages 47 in the low pressure 180° inlet arc segment between the ends of the vanes 13 member and the adjacent faces of the bearings 15 and 16. The fuel is drawn axially from both directions into the vane slot extremities 31 and the expanding vane buckets 29 and into the undervane areas 33 for compression and discharge as the rotation of the rotor member 12 around the eccentric cam surface 14a produces contracted vane buckets 29a and depresses the contoured undersurfaces 13a of the vanes 13 into the undervane areas 33 in the high pressure discharge arc segment of the bearings 15. This pumps the liquid through 180° discharge ports 55 in the outlet arc segment of the bearings 15 and 16 and through discharge passages 37 to the engine or other destination.

In operation, the fuel is introduced to the expanding inlet bucket areas 29 and undervane areas 33 axially from both directions towards the center of the vanes 13 in the 180° inlet arc, and is discharged axially in both directions in the discharge arc, the liquid present at the center of the vanes 13 and undervane areas 33 in the contracted vane bucket areas being furthest from the discharge ports 55 in the opposed bearings 15 and 16. In conventional vane pumps this has resulted in a reduced circulation of the liquid at the centerline of the rotor and cam chamber, producing stagnant residual or uncirculated fluid which becomes overheated due to its continued residence within the pump and contact with the vanes 13 which are in continuous frictional engagement with the cam surface. While continuously-replenished fluid serves as a coolant for the vanes and vane slots, uncirculated stagnant fluid can become overheated and the center of the vane tips can expand or swell or bulge to cause scoring of the contacting cam surface and eventually pump failure.

Figure 5:
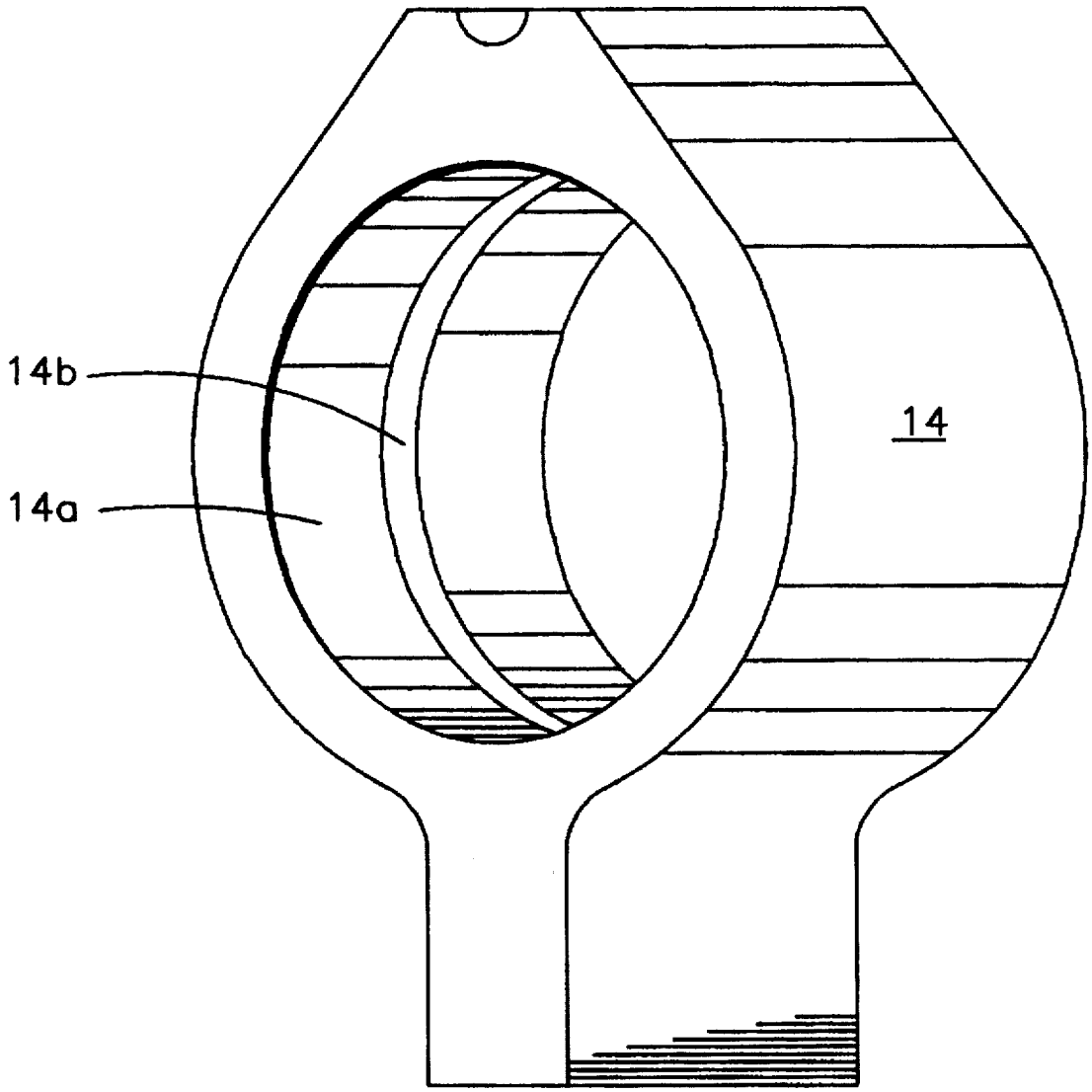
FIG. 5 is a perspective view of a novel cam member having a central continuous recess or groove cut into the inner diameter surface of the cam chamber.

These problems are overcome or avoided by the discovery that the failure of the fluid to continuously circulate through the central bucket and undervane areas of the conventional vane pumps can be corrected by providing the tips **13*b* of the vanes 13 with a central recess 13*c*, shown in FIGS. 1 and 4, and/or by providing the cam surface 14*a* with a central continuous transverse recess or groove 14*b*, shown in FIG. 5. The central recesses 13*c* enable the fluid to circulate between bucket areas, from one bucket area through a vane recess 13*c* into the next bucket area in the inlet and seal arcs of the pump and also in the discharge and seal arcs of the pump, thereby avoiding stagnant fluid at the center of the bucket areas or developing an air pressure or a vacuum barrier blocking the flow of fluid thereto or therefrom. The vane recesses 13*c*** vent the central bucket areas to improve fluid circulation and avoid fluid stagnation.

The central groove **14*b* in the cam surface may be used instead of or in addition to the vane tip recesses 13*c*, and functions in the same manner to allow fluid to fill the bucket areas and undervane areas and flow into the vane groove 14*b* in the inlet and seal arcs of the pump, and to allow the fluid to be pumped from the bucket areas and undervane areas and the groove 14*b* in the discharge and seal arcs of the pump, thereby also providing cooling flow over the vane tips as the fluid leaks through the groove 14*b*. Additionally the cam groove 14*b***, being continuous equalizes the vane stage internal pressure and helps to suppress bubble formation during low inlet pressure operation of the vane stage.

What is claimed is:

1. A durable, single action, variable displacement vane pump capable of pumping of liquids comprising:

(a) a cylindrical rotor member having journal ends and a central vane section comprising a plurality of radial vane slots uniformly spaced around the central circumference thereof, said vane slots being elongate in the axial direction and each having a central vane-supporting portion;

(b) a plurality of vane elements, each slidably-engaged within the central vane-supporting portion of a said vane slot for radial movement therewithin to form vane bucket areas therebetween;

(c) a unitary cam member having opposed faces and a circular transverse bore therethrough forming a cam chamber having an interior cam surface, the central vane section of said rotor member being supported axially and non-concentrically within said cam chamber so that the outer tip surfaces of all of the vane elements make contact with said interior cam surface during rotation of said rotor member, except at the rotational center of said interior cam surface where each said vane tip surface or said cam surface is provided with a central recess or groove which spaces said vane tip surfaces from said interior cam surface along a narrow central area around the entire interior cam surface in the direction of rotation of said rotor member, which narrow central area is open to the circulation of liquids being pumped, to prevent stagnation and overheating of said liquids;

(d) an opposed pair of bearing seals rotatably supporting the journal ends of said rotor member, each said bearing seal having a face surface which contacts a face surface of said cam member and encloses the central vane-supporting portion of said rotor member within said cam chamber, each bearing seal having an inlet arc segment comprising means for admitting fluid to expanding vane bucket areas of the rotating vaned rotor and through said central recesses or grooves, and into said vane slots and undervane areas, and a discharge arc segment comprising means for discharging pressurized fluid from contracting vane bucket areas and through said central recesses and grooves of the rotating vaned rotor and from undervane areas as the vanes are depressed into the vane slots during rotation through the discharge arc, said cam member being adjustable relative to said vaned rotor to vary the extent of eccentricity therebetween for varying the displacement capacity of said vane pump.

2. A vane pump according to claim 1 in which said interior cam surface is continuous, and each of said vane tip surfaces is provided with a central recess which spaces a narrow central area of the vane against contact with the continuous cam surface.

3. A vane pump according to claim 1 in which each of said vane tip surfaces is continuous, and the interior cam surface is provided with a central peripheral groove which spaces the central area of the cam surface against contact with the continuous vane tip surfaces.

4. A vane pump according to claim 1 in which each face of the cam member contains inlet means adjacent an arcuate segment of the cam bore, corresponding to the inlet arc of the bearing faces, to admit inlet fluid to the expanding vane bucket areas.

5. A vane pump according to claim 1 in which each bearing face comprises an inlet arc of about 180°, a seal arc of about 36°, a discharge arc of about 108° and a second seal arc of about 36°.

6. A vane pump according to claim 1 in which said rotor member comprises a cylindrical barstock of relatively-uniform diameter having journal ends of said diameter.

7. A vane pump according to claim 1 in which said central vane section comprises a plurality of radially-extending teeth, adjacent pairs of said teeth being formed as wall extensions of said vane slots to further support said vane elements during their radial movement within the vane slots.

8. A vane pump according to claim 1 in which each said vane slot has an arcuate floor which tapers uniformly from the central maximum depth portion upwardly and outwardly to said extension portions.

9. A unitary cam member for a variable displacement vane pump, comprising a housing having opposed parallel face surfaces, a circular bore through said housing and face surfaces forming an interior cam chamber having a circular cam surface designed to be engaged by the tips of vane elements of a vaned rotor member supported for rotation within said cam chamber, said cam surface being provided with a continuous circular narrow recess or groove at the center thereof, between said face surfaces.

10. A cam member according to claim 9 in which corresponding arcuate portions of the opposed face surfaces are undercut, adjacent the circular bore, to provide fluid inlet passages to said cam chamber.

* * * * *